United States Patent [19]

Belz

[11] 4,261,066

[45] Apr. 14, 1981

[54] TOILET SEAT COVER

[76] Inventor: Roland Belz, Finkenweg 20, 7021 Leinfelden-Echterdingen, Fed. Rep. of Germany

[21] Appl. No.: 872,580

[22] Filed: Jan. 26, 1978

[30] Foreign Application Priority Data

Jan. 26, 1977 [DE] Fed. Rep. of Germany ..... 2703005

[51] Int. Cl.[3] ..... A47K 13/14

[52] U.S. Cl. ..... 4/222; 4/242; 4/243; 4/245; 428/65; 428/137; 428/90; 428/337; 428/339; 428/292; 428/401; 428/507; 428/522

[58] Field of Search ..... 428/65, 90, 131, 137, 428/292, 337, 339, 401, 500, 507, 510, 522; 4/242–247, 222, 229, 230; 156/72

[56] References Cited

U.S. PATENT DOCUMENTS

| | | | |
|---|---|---|---|
| 3,765,922 | 10/1973 | Chisholm | 428/90 X |
| 3,922,410 | 10/1975 | Halloran | 428/90 X |
| 4,062,992 | 12/1977 | Power et al. | 428/90 |

FOREIGN PATENT DOCUMENTS

| | | | |
|---|---|---|---|
| 1776170 | 10/1958 | Fed. Rep. of Germany . | |
| 1833747 | 6/1961 | Fed. Rep. of Germany . | |
| 6924322 | 6/1969 | Fed. Rep. of Germany . | |
| 7001164 | 1/1970 | Fed. Rep. of Germany . | |
| 2216288 | of 1973 | Fed. Rep. of Germany | 4/243 |
| 7436235 | 10/1974 | Fed. Rep. of Germany . | |
| 2504494 | 3/1975 | Fed. Rep. of Germany . | |

*Primary Examiner*—George F. Lesmes
*Assistant Examiner*—Alexander S. Thomas
*Attorney, Agent, or Firm*—Brumbaugh, Graves, Donohue & Raymond

[57] ABSTRACT

A toilet seat cover is provided in the form of a blank consisting of at least one layer having a central opening, said layer being formed of a non-porous flexible foil such as of polyvinyl alcohol which foil is soluble in an aqueous medium, the foil being provided on one side with fibres such as of textile waste which fibres are bonded to the foil but freely exposed over part of their length. An endless chain of such covers is also provided.

4 Claims, 4 Drawing Figures

TOILET SEAT COVER

BACKGROUND OF THE INVENTION

1. Field of the Invention

Figure 1:
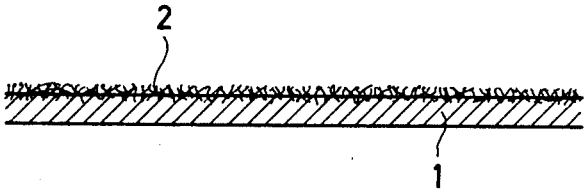

This invention relates to a toilet seat cover in the form of a blank composed of one or more layers and having a central opening, one layer of which blank is formed by a thin foil which is substantially waterproof at least for a short time, and to a process for the manufacture of this cover.

2. Prior Art

In German Offenlegungsschrift No. 25 04 494 there has been described a toilet seat cover in which a non-woven fabric of fibres is sealed off to render it substantially non-porous by means of a sealing compound which dissolves slowly in water, for example a polyvinyl alcohol, so that the cover becomes non-porous and impervious while in use. However, polyvinyl alcohol is required in relatively large quantities to seal the fabric to render it non-porous. If a very compact non-woven fabric of fibres is used, the relatively viscous polyvinyl alcohol solution does not easily penetrate the fabric, so that air is liable to be included, which may subsequently lead to the formation of pores. Moreover, polyvinyl alcohol is relatively expensive, so that it is desirable to use the lowest possible proportion of polyvinyl alcohol to fibrous material.

It is an object of the present invention to provide a toilet seat cover which is easily manufactured and absolutely hygienic by virtue of being completely impervious.

SUMMARY OF THE INVENTION

The invention is characterised in that a layer of a non-porous flexible foil is formed from a material which is soluble in an aqueous medium, which foil has a fibrous material bonded to it on one side, the fibres of which material are freely exposed on the surface of the foil over part of their length.

The substance primarily to be chosen as the material which is soluble in an aqueous medium is again a polyvinyl alcohol although other materials may be used, such as those mentioned in German Offenlegungsschrift No. 25 04 494. The aqueous medium would generally be water or effluent.

In contrast to the embodiment described in German Offenlegungsschrift No. 25 04 494, the toilet seat cover according to the present invention comprises a closed, non-porous foil which is therefore completely impervious regardless of its thickness. It is therefore possible to save material by using a very thin foil since it need only be thick enough to provide the necessary mechanical strength. The fibre material applied to the side of the foil which forms the upper surface in use fulfills a double purpose. It serves as thermal insulation, which is particularly advantageous in unheated lavatories, and it serves as moisture insulation which, at least initially, prevents body moisture from penetrating to the foil. The fibres preferably do not penetrate right through the thickness of the foil, and they are advantageously not joined together.

The fibrous material is preferably formed from textile waste fibres. The process therefore provides a suitable means of utilizing this waste product. The fibres may have different lengths and generally have an average length of approximately 0.5 mm. Suitable materials include inter alia finely divided cellulose, e.g. in the form of fibres, fluff or powder (average particle size 0.05 to 0.5 mm).

The process for the manufacture of the cover is characterised in that a foil having one adhesive surface is manufactured from a material which is soluble in an aqueous medium, and the adhesive surface is then covered with short individual fibres. The foil is preferably produced by applying a solution to a support which is relatively non-adhesive. The fibres may be applied to the partly dried material of the foil while the surface of the foil is still tacky. In this embodiment of the process, the individual fibres are therefore directly fixed in the foil of water soluble material, but only over part of their length. Another possible method consists of first manufacturing the foil and then covering it with a suitable water soluble adhesive, for example in the form of a solution which does not attack the foil, and then applying the fibre material to the thin layer of adhesive. The adhesive serves as a bond between the fibres and the foil. In this embodiment, the foil itself may be very thin, in the case of polyvinyl alcohol generally in the region of about 5 to 10 g/m$^2$, whereas if the fibres are directly fixed in the foil, a thicker foil should be used (in the case of polyvinyl alcohol approximately 10 to 20 g/m$^2$ of the weight of the foil).

If polyvinyl alcohol is used as the material for manufacturing the foil, solutions having a solids content of from 10 to 30% by weight of polyvinyl alcohol are generally employed. When such solutions are applied to form layers weighing approximately 50 to 200 g/m$^2$, the foil obtained after drying weighs approximately 5 to 25 g/m$^2$. If necessary, wetting agents and anti-foaming agents may be added to the solutions in order to ensure that they will form a closed, non-porous layer even when applied to a support which is relatively non-adhesive. The water soluble material may be chosen or adjusted so that the resulting foil remains virtually undissolved while in use for the purpose intended.

According to a preferred embodiment of this invention, that side of the foil which is remote from the fibres is covered with a waterproof or water repellent coating. This coating may consist of an extremely thin layer of water resistant synthetic material. Suitable materials for this purpose include inter alia polyvinyl chloride, pioloform (acetal of polyvinyl alcohol and butyraldehyde) and vinnapas (thermoplastic synthetic resin-polyvinyl acetate and its copolymers). Among these materials, pioloform and vinnapas are preferred not only because they are water resistant and provide an efficient seal even when applied in an extremely thin layer of from 1 to 5 g/m$^2$ but also because they have the particularly advantageous property of being biologically degradable. This so called sealing layer, which is applied to the undersurface of the foil made of a material which is soluble in an aqueous medium, increases the mechanical strength of the cover as a whole and provides absolute protection against softening of the foil by any moisture on the toilet seat.

According to a further development of this invention, the sealing layer may be made of a material which is soluble in acid or alkaline aqueous solutions or disintegrates into dispersible particles in such solutions but is insoluble in substantially neutral solutions. In this embodiment of the invention, acid or basic substances, depending on the nature of the sealing layer, may be incorporated in the foil itself to ensure that the sealing layer will dissolve. When the foil is dissolved by liquid penetrating from the side covered with fibres, the acid or basic substances in the foil are released so that they dissolve the sealing layer which is in direct contact with the foil. Since this sealing layer is very thin, it dissolves before the acid or basic substances are washed away.

A particularly suitable material which is soluble in alkaline aqueous solutions is a copolymer of vinyl acetate containing a small proportion of crotonic acid, in other words of polyvinyl acetate which has free carboxyl groups (e.g. Vinnapas 305). This vinylacetate copolymer may be stabilized by the addition of a vinylacetate homopolymer or other synthetic resins. Thus for example a suitable sealing layer may consist of 50% vinylacetate copolymer having free carboxyl groups, 50% vinylacetate homopolymer and an addition of approximately 4.5% dibutylphthalate as plasticizer. When an organic solution having a solid content of 30% by weight composed of these substances is applied to form a layer weighing 20g/m$^2$ when wet, the sealing film finally obtained weighs 6 g/m$^2$. (Since the density of the materials used for the individual layers is generally circa 1.3, the thickness of the layer in microns is calculated approximately by multiplying the weight of the layer in g/m$^2$ by the factor 0.75.)

The base required for dissolving such a sealing layer may be incorporated in the foil of water soluble material. For example, one percent by weight of sodium hydroxide or sodium carbonate, based on the solid content of water soluble material, may be added to the aqueous solution from which the foil is produced. When the solution dries to form the foil, the basic substance is uniformly distributed in the foil. Any water coming into contact with the seal from below cannot dissolve this seal but only, at most, cause it to swell after some time. If, on the other hand, the cover is flushed away after use, water reaches the upper surface of the foil, which is covered with the fibre material, so that the foil dissolves and at the same time provides the alkaline aqueous medium which is capable of dissolving or disintegrating the sealing layer.

The degree of solubility of the material which is soluble in an aqueous medium is chosen according to whether or not a sealing layer is provided. For example, a polyvinyl alcohol having a saponification number of circa 70 to 290 may be used, i.e. a readily soluble polyvinyl alcohol, if the under surface of the foil is sealed. If, on the other hand, the under surface of the foil is not sealed with a special waterproof layer, there would generally be used a polyvinyl alcohol having a saponification number of from 10 to 50 or corresponding mixtures. The solubility of the polyvinyl alcohol can thus be adapted to the requirements so that even if the toilet seat is wet the foil would at most swell but not dissolve. It is only when the cover is flushed away that the foil gradually dissolves.

The sealing layer may be very thin, as already mentioned above, and is suitably in the region of from 1 to 5 g/m$^2$. In an aqueous medium, for example in effluent, the foil of soluble material is dissolved by the medium reaching it through the layer of fibres. The sealing layer is then left over but since it is very thin it shrivels up into a ball which causes no obstruction in the effluent. However, the sealing layer may be provided with at least one radial separating line when it is first applied. This ensures that when the layer becomes detached, it will not retain its form as a ring which could get caught on projections or the like.

The toilet seat cover according to this invention is particularly suitable for continuous mass production. The solution of material which is soluble in an aqueous medium may advantageously be applied to a suitable support in the shape which it will have as finished product. For example, it may be applied by means of an intaglio cylinder to an endless belt of polytetrafluoroethylene (PTFE). This cylinder may print individual covers on the belt but for mass production it is preferred to print a continuous chain of covers in the form of rings which are joined together along their common edges. This printing of the covers in their final shape has the major advantage that no waste is produced. If the fibres are to be fixed in the foil before the surface has dried, this can be done by flocking the moist foil with textile fibres while it is still on the support. If, on the other hand, the fibres are to be fixed to the foil by means of an adhesive, the adhesive may be applied to the foil blanks by means of a second cylinder in registration with the first. Alternatively, the foil or chain of foils comprising the plurality of individual rings may be lifted from the support before being sprayed with adhesive. The hanging chain of foils may then be flocked with textile fibres while being transferred from one support to another.

The sealing layer may also be applied by means of a second printing cylinder while the foil is still on the supporting band. In that case, the other side of the foil is flocked only after the foil has been lifted from its support. Sealing of the under surface is preferably carried out by applying the synthetic sealing material in the form of a solution or dispersion, care being taken to ensure that the foil of material which is soluble in an aqueous medium is not dissolved in the process or only to an insignificant extent. The cover could also be built up layer by layer from below upwards, starting with the sealing layer, except in cases where the solution used for producing the foil contains substances which, as mentioned above, are used subsequently to dissolve the sealing layer.

Other features of the invention will be clear from the following description of embodiments in conjunction with the drawings and claims.

Figure 2:
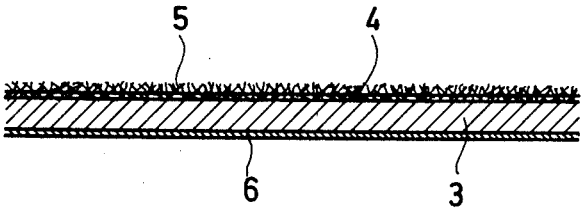
Figure 3:
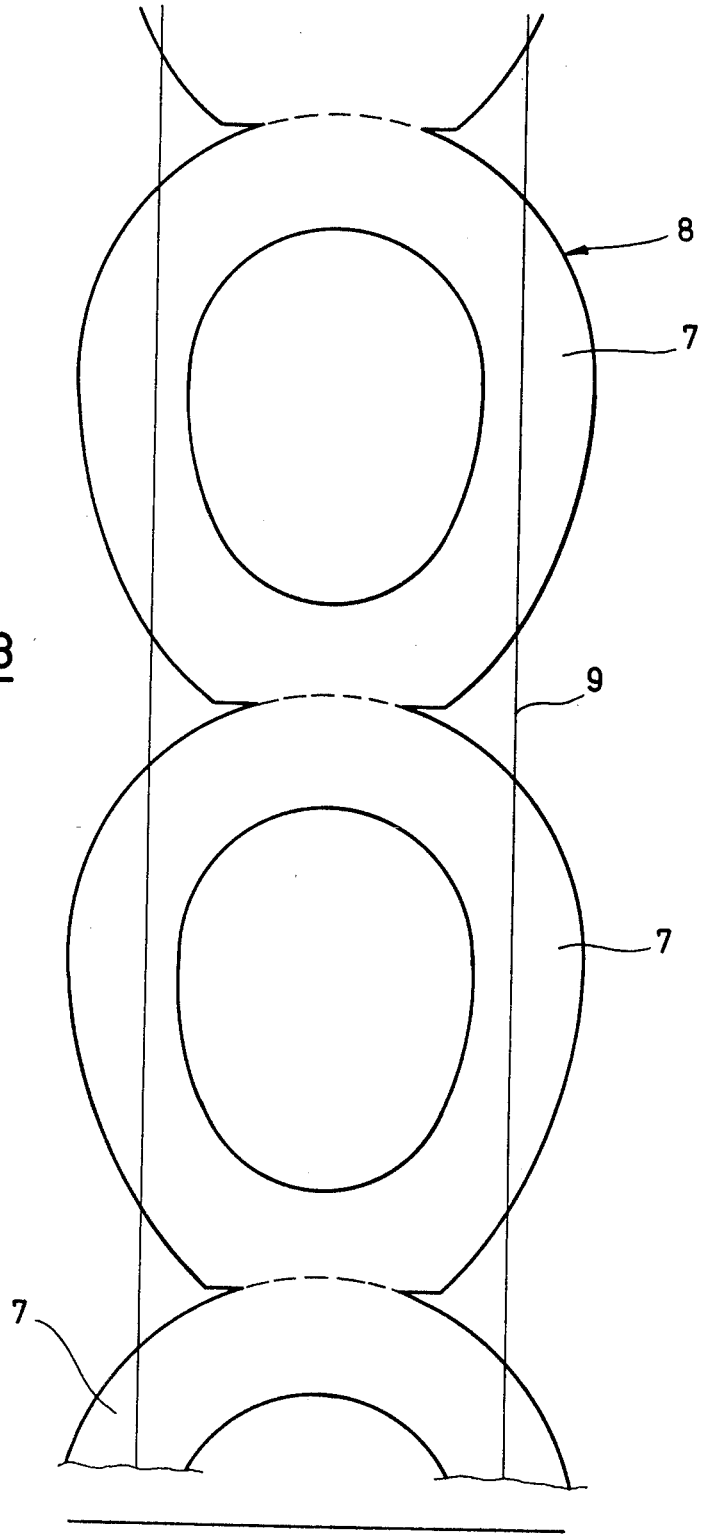
Figure 4:
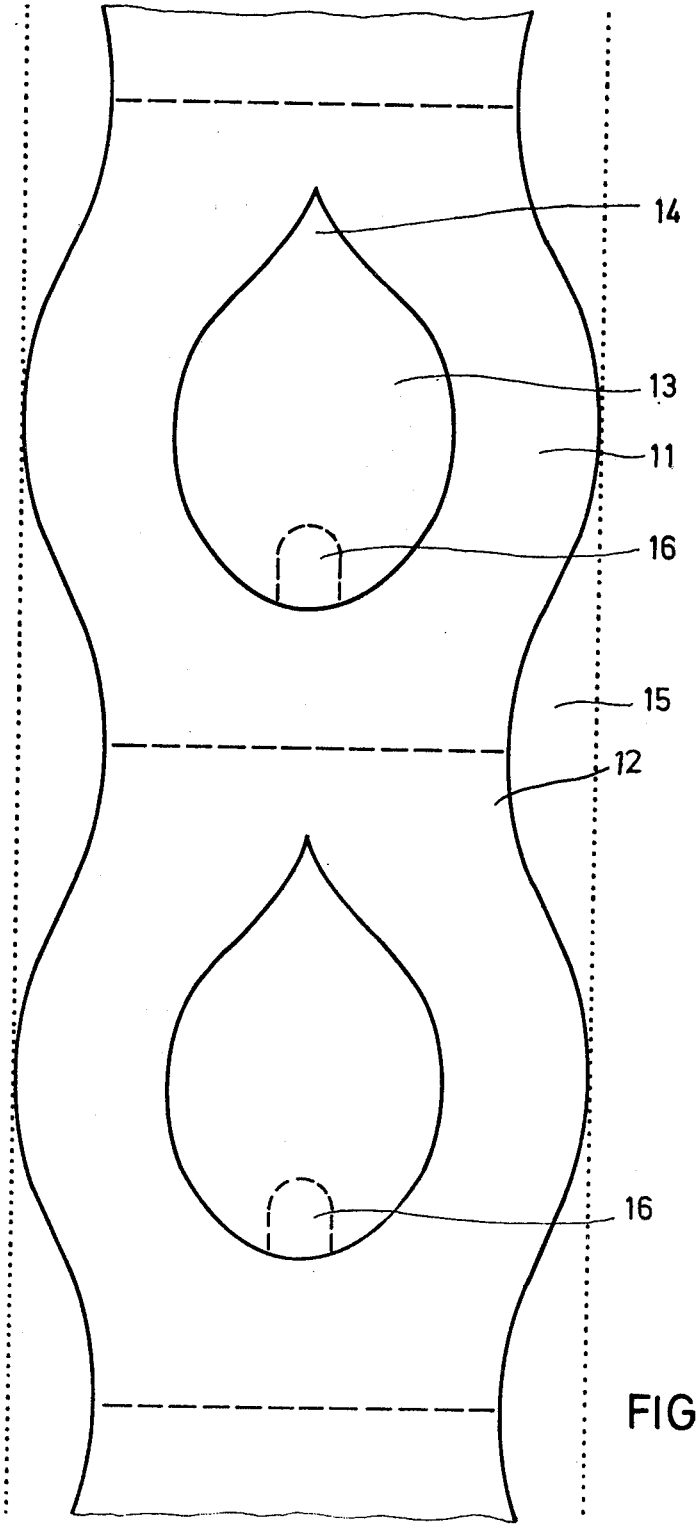

In the drawings,

FIG. 1 represents a partial cross-section through one embodiment of the invention, FIG. 2 represents a partial cross-section through another embodiment of the invention, FIG. 3 represents a top plan view of a chain of continuously produced toilet seat covers in the form of rings, and FIG. 4 represents a top plan view of another embodiment of this invention.

In the embodiment of the invention represented in FIG. 1, a foil 1 of polyvinyl alcohol having a thickness of circa 15 micron is covered on its upper surface with a layer 2 of textile waste fibres. The individual fibres penetrate the foil 1 to a depth of approximately ⅓rd of the thickness of the foil and are thus fixed in the foil. For the most part of their length, the fibres are freely exposed on the surface of the foil so that the surface has a felt-like character.

To produce the embodiment illustrated in FIG. 1, an aqueous solution of polyvinyl alcohol (saponification No. 20) having a solid content of circa 15% by weight may be applied by means of an intaglio cylinder to an endless belt of PTFE serving as support to form thereon a plurality of individual covers in the form of rings joined together to form a chain. A wetting agent has previously been added to the polyvinyl alcohol solution to assist wetting of the PTFE support. An anti-foaming agent is used so that the foil will be formed free from bubbles. The polyvinyl alcohol solution is applied to form a layer of such thickness that when dry the resulting foil will weigh circa 10 to 20 g/m$^2$. Before the foil is dry, textile fibres in the form of flock is dropped on the chain of rings from above to become bonded with the foil. When the foil has dried, it can be lifted from the PTFE belt and the individual covers may then be separated. Alternatively, the entire chain of covers may be folded up into a packet and packaged as such. The under surface of foil 1 may be covered with a thin film of grease or resin to grip the cover to the toilet seat. This film at the same time provides a certain protection against moisture for the foil. A disinfectant which is harmless to the skin may also be added to the film.

In the embodiment represented in FIG. 2, the cover is composed of several layers. A foil 3 of polyvinyl alcohol has a thin layer 4 of adhesive, e.g. polyvinyl pyrrolidone, on its upper surface. A layer 5 of fibres forming the upper surface of the cover is fixed in the layer of adhesive 4. The under side of the cover has a seal 6 of Vinnapas. The polyvinyl alcohol foil has a thickness corresponding to circa 7 to 10 g/m$^2$. The layer of adhesive and the layer of seal 6 weigh each only circa 3 g/m$^2$. The fibres of layer 5 are fixed in the layer of adhesive 4 and do not penetrate the PVA foil 3. This embodiment of the invention provides complete protection against moisture from below. Due to its composite structure of seal 6, PVA foil 3, layer of adhesive 4 and fibre layer 5, it is mechanically extremely stable as well as being heat insulating although the whole composite structure is very thin.

The embodiment represented in FIGS. 2 and 3 is produced by first printing an endless chain of contiguous rings 7 on the support of PTFE by means of an intaglio raster cylinder. A 15% solution of polyvinyl alcohol (molecular weight 49,000) having a saponification number of circa 140 is used for this purpose, and is applied in a thickness of circa 50μm when wet. The polyvinyl alcohol solution is left to dry completely and a second printing cylinder is then brought into exact registration with the first to apply a sealing layer in the form of a 15% solution of polyvinyl acetate having a thickness of 20μm when wet, and the resulting chain 8 of rings is then lifted from the support. The rings 7 are preferably joined together end to end in the chain so that the front edge of one ring is contiguous with the rear edge of the following ring. The layer of adhesvie 4, e.g. In the form of a 10% solution of a highly viscous polyvinyl pyrrolidone in a monohydric alcohol, may then be applied to the other side of the foil 3 to form a layer 15μm in thickness when wet, by spraying the solution to the freely suspended chain of rings or by passing the suspended chain over an applicator roller. Immediately after application of the layer of adhesive, that side of the foil 3 which has been covered with adhesive is flocked with the textile fiberes, which adhere to the adhesive to form a layer of the required thickness. If desired, the layer 3 of fibres may be slightly pressed into the layer of adhesive by passing the chain of rings over a suitably formed cylinder.

Reinforcing fibres 9 may be incorporated when manufacturing the foil of polyvinyl alcohol. This can easily be done by placing the fibres on the PTFE belt before the polyvinyl alcohol solution is printed on the belt, so that the fibres move with the belt. The reinforcing fibres facilitate removal of the chain of rings from its support and take up the forces of traction as the chain is transported over the various cylinders. One or more radial gaps may be left in the sealing layer 6 on each individual ring 7 so that when the cover subsequently dissolves in effluent, the ring of sealing layer breaks up into segments.

In the embodiment illustrated in FIG. 4, the chain of foils 11 has the form of rings 12 which gradually merge into each other and each of which has a substantially drop-shaped opening 13 the tip 14 of which points in the direction in which the chain 11 is stripped from the supporting belt 15. This design allows for a high speed of production without risk of the chain of foils tearing as it is stripped from the supporting belt. A projection 16 in the form of a tongue projection from the internal rim at the front of the foil is particularly advantageous for the hygienic requirements of the user.

The cover according to this invention is valuable from a hygienic point of view but at the same time environmentally harmless. The foil made of a material which is soluble in an aqueous medium dissolves completely in the effluent. Since the adhesive is also water soluble, the fibres from the fibre layer are always completely detached, regardless of whether they are fixed in the foil or in the layer of adhesive. The sealing layer, which is only a few micron in thickness, has very little stability once it has become detached from the cover. It shrivels up and is torn by the slightest mechanical action in the effluent even if no separating lines have been provided, and it rots or is biologically degraded or may even dissolve completely.

The cover according to the invention may be manufactured continuously at high piece rates on a rational basis. It is particularly suitable to use, for this purpose, a support in the form of a belt which already has the form of the chain of contiguous foils, e.g. as shown in FIG. 4. In that case, the various layers may then be built up one above the other by successive application, e.g. by means of cylinders. A conventional conveyor belt having elevations in the form of the individual covers or of a chain of foils may also be used.

I claim:

1. A toilet seat cover in the form of a blank consisting of at least one layer with a central opening, which layer is formed of a foil of polyvinyl alcohol, and is provided on one side with a fibrous cellulosic material constituted of textile waste, the fibres having an average length of 0.05 to 0.5 mm, said fibres being partly exposed on the surface of the foil, said foil having a thickness of about 5 to 20 micron and the weight ratio of the foil to the fibres of the fibrous material being from 2:1 to 1:5, and wherein said cover further comprises a sealing layer of waterproof and water insoluble material on that side of the foil which is remote from the fibres, in which that side of the cover which is remote from the fibres is also provided with a bonding agent, and wherein said bonding agent contains a disinfectant.

2. A toilet seat cover in the form of a blank consisting of at least one layer with a central opening, which layer is formed of a foil of polyvinyl alcohol, and is provided on one side with a fibrous cellulosic material constituted of textile waste, the fibres having an average length of 0.05 to 0.5 mm, said fibres being partly exposed on the surface of the foil, said foil having a thickness of about 5 to 20 micron and the weight ratio of the foil to the fibres of the fibrous material being from 2:1 to 1:5, and wherein said cover further comprises a sealing layer of waterproof and water insoluble material on that side of the foil which is remote from the fibres, in which the sealing layer is insoluble in substantially neutral aqueous solutions but at least partly soluble in acid or alkaline solutions, and in which an acid or alkaline substance is incorporated in the foil.

3. A toilet seat cover in the form of a blank consisting of at least one layer having a central opening, which layer comprises a nonporous flexible foil of a material which is soluble in an aqueous medium, fibrous material means bonded to one side of said foil, the fibres of said fibrous material means being freely exposed on the surface of the foil over part of their length, for providing at least a minimum barrier against moisture penetrating to the foil, and a sealing layer of waterproof and water insoluble material on that side of the foil which is remote from the fibres, wherein said sealing layer is insoluble in substantially neutral or aqueous solutions but at least partly soluble in acid or alkaline solutions, and in which an acid or alkaline substance is incorporated in said foil.

4. A cover according to claim 3, wherein said fibres are embedded in said foil over part of their lengths to be individually bonded to said foil.

* * * * *